US010351387B2

(12) United States Patent
Steinhauer et al.

(10) Patent No.: US 10,351,387 B2
(45) Date of Patent: Jul. 16, 2019

(54) ELEVATOR WITH A BRAKE DEVICE

(71) Applicants: ThyssenKrupp Elevator AG, Essen (DE); ThyssenKrupp AG, Essen (DE)

(72) Inventors: Eduard Steinhauer, Nürtingen (DE); Thomas Kuczera, Leinfelden-Echterdingen (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 178 days.

(21) Appl. No.: 15/522,352

(22) PCT Filed: Oct. 26, 2015

(86) PCT No.: PCT/EP2015/074757
§ 371 (c)(1),
(2) Date: Apr. 27, 2017

(87) PCT Pub. No.: WO2016/071141
PCT Pub. Date: May 12, 2016

(65) Prior Publication Data

US 2017/0320706 A1 Nov. 9, 2017

(30) Foreign Application Priority Data

Nov. 7, 2014 (DE) ..... 10 2014 116 281

(51) Int. Cl.
*B66B 5/18* (2006.01)
*B66B 5/22* (2006.01)
(Continued)

(52) U.S. Cl.
CPC ..... *B66B 5/22* (2013.01); *B66B 5/18* (2013.01); *B66B 5/24* (2013.01); *B66D 1/06* (2013.01);
(Continued)

(58) Field of Classification Search
CPC ..... B66B 5/18; B66B 5/16; B66B 5/20
See application file for complete search history.

(56) References Cited

U.S. PATENT DOCUMENTS 5,244,060 A 9/1993 Tanaka
6,193,026 B1 2/2001 Sevilleja
(Continued)

FOREIGN PATENT DOCUMENTS

CN 1189442 A 8/1998
CN 101855157 A 10/2010
(Continued)

OTHER PUBLICATIONS

English translation of International Search Report issued in PCT/EP2015/074757, dated Dec. 3, 2015 (dated Oct. 12, 2015).

*Primary Examiner* — Diem M Tran
(74) *Attorney, Agent, or Firm* — thyssenkrupp North America, Inc.

(57) ABSTRACT

An elevator with a brake device may be configured to provide a variable brake force, from a minimum brake force up to a maximum brake force (Vmax). The brake device may include a first energy store that provides the maximum brake force and a second energy store that provides an adjustable counterforce. The adjustable counterforce may be directed in an opposed manner with respect to the maximum brake force provided from the first energy store. Further, the variable brake force may amount to a difference between the maximum brake force and the adjustable counterforce. In some cases, the first energy store may comprise a compression spring for providing the maximum brake force.

21 Claims, 9 Drawing Sheets

(51) Int. Cl.

| | |
|---|---|
| ***B66B 5/24*** | (2006.01) |
| ***B66D 1/06*** | (2006.01) |
| *B66D 1/48* | (2006.01) |
| *B66D 1/58* | (2006.01) |
| *B66D 5/26* | (2006.01) |

(52) U.S. Cl.
CPC ..... *B66D 1/485* (2013.01); *B66D 1/58* (2013.01); *B66D 5/26* (2013.01)

(56) References Cited

U.S. PATENT DOCUMENTS

| | | | | |
|---|---|---|---|---|
| 6,719,101 | B2 * | 4/2004 | Hugel | B66B 5/22 187/372 |
| 7,575,099 | B2 * | 8/2009 | Oh | B66B 5/06 187/247 |
| 9,120,643 | B2 * | 9/2015 | Meierhans | B66B 5/20 |
| 2006/0180406 | A1 * | 8/2006 | Gremaud | B66B 5/16 187/355 |
| 2017/0291794 | A1 * | 10/2017 | Bitzi | B66B 1/32 |

FOREIGN PATENT DOCUMENTS

| | | | |
|---|---|---|---|
| EP | 0856485 | A | 8/1998 |
| EP | 2058262 | A | 5/2009 |
| EP | 2223880 | A | 9/2010 |

* cited by examiner

ELEVATOR WITH A BRAKE DEVICE

CROSS REFERENCE TO RELATED APPLICATIONS

This application is a U.S. National Stage Entry of International Patent Application Serial Number PCT/EP2015/074757, filed Oct. 26, 2015, which claims priority to German Patent Application No. DE 10 2014 116 281.1 filed Nov. 7, 2014, the entire contents of both of which are incorporated herein by reference.

FIELD

The present disclosure generally relates to elevators with brake devices, including service brakes and safety catch devices.

BACKGROUND

Service brakes and safety catch devices are absolutely necessary in elevators, which service brakes and safety catch devices reliably decelerate the car of the elevator to a standstill in the case of excessive speed and/or uncontrolled travel movements.

Service brakes of this type can act, for example, on a traction sheave of the elevator or can be arranged on the car of the elevator and can act on the guide rails.

A brake device preferably produces a constant brake force which is usually set in such a way that the car which is loaded with a nominal load is braked with a deceleration of from 0.8 to 1 g for safety catch devices and from 0.3 to 0.5 g for service brakes.

In order to minimize the risk of injury to elevator passengers during a brake operation of the car, the brake deceleration of the brake device can be limited by way of setting, for example by way of controlling or regulating. Since the brake deceleration of the car is dependent on the car weight and the loading of the car, the brake force should be adapted to the loading of the car. With increasing complexity, a brake device of this type still has to ensure the required degree of safety. It is one safety requirement that the brake device operates according to the closed circuit principle (active when switched on). However, the closed circuit principle requires a continuous feed of energy into an actuator system of the brake device. This leads to an increased energy consumption of the brake device.

If, in contrast, the brake device operates according to the open circuit principle, an energy store is required which provides the energy which is required for closing the brake device if an energy supply of the brake device is interrupted. Since a regulation of the brake force is associated with a high energy requirement, great energy quantities have to be provided. This leads to a brake device with a complex construction.

The brake lining, in particular the coefficient of friction between the brake lining and the guide rail or the traction sheave, has a further decisive influence on the brake force. A change in the coefficient of friction has a direct action on the brake force and on the deceleration which is set. If a brake force correction upon a change in the coefficient of friction is not provided, this has the consequence that the brake force either increases and the car is decelerated to a more pronounced effect, or else the brake force decreases if, for example, oil is situated on the guide rail and the car then cannot come to a standstill.

Furthermore, brake devices, in particular brake linings which are frequently used in a service brake, are subject to wear.

A brake device on the car can comprise two brake units which act in each case on one of two guide rails. The two brake units of the brake device are connected rigidly (positively) to one another via a shaft. This has the consequence that first of all the same brake forces act on guide rails which are arranged on the two sides of the car. As a result of tolerances, guide rail condition or different contamination, however, different brake forces can act on the two sides of the car on account of the abovementioned wear processes and can additionally load the car by way of a torque which is set as a result.

EP 2 058 262 B1 has disclosed a brake device for braking a car of an elevator system, which comprises a pawl which can be adjusted between two operating positions. In the first operating position, the pawl is connected to a brake module in such a way that a release force is transmitted from the pawl to the brake module. In the first operating position, the width of the air gap between the brake module and the device can be set by way of regulation of the release force, in order to set the brake force in this way. In the second operating position, an emergency brake operation of the car takes place, by the pawl being disconnected from the brake module.

There is a need for an elevator with a brake device, the brake device providing a brake force of a magnitude which can be set and is therefore adapted to the respective operating situation, and which brake device has a simple construction.

DETAILED DESCRIPTION

Figure 1:
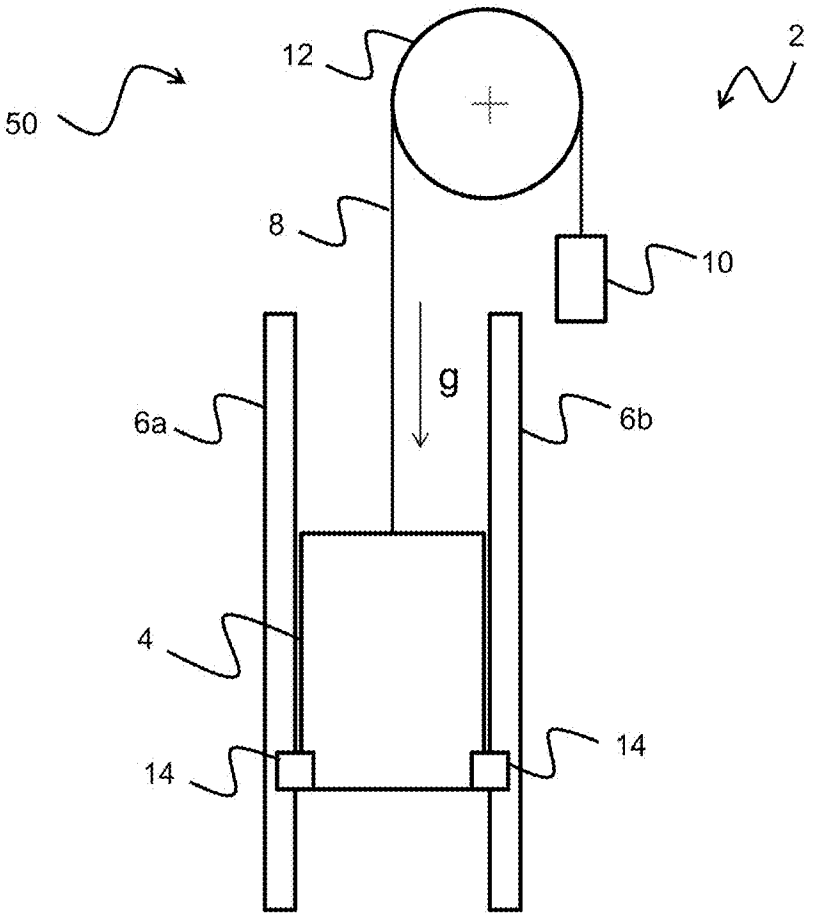
FIG. 1 is a diagrammatic view of an example elevator with a brake device.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The elevator according to the invention comprises a brake device, in particular a service brake and/or safety catch device, the brake device being configured for providing a variable brake force from a minimum brake force up to a maximum brake force. In order to provide the variable brake force, a first energy store is provided for providing the maximum brake force, and a second energy store is provided for providing an adjustable counterforce which is directed in an opposed manner with respect to the maximum brake force. Here, the variable brake force is the difference of the maximum brake force and the adjustable counterforce.

The invention is based on the finding that a brake force of adjustable magnitude and therefore a variable brake force can be provided in a particularly simple way by way of subtractive superimposition of the maximum brake force and the provided adjustable counterforce. In this way, a brake device with a simple construction is provided, by way of which brake device a variable brake force can be provided in normal operation and a maximum brake force can be provided in the case of an emergency.

In one advantageous refinement of the invention, the first energy store comprises a compression spring for providing the maximum brake force. By way of this, a brake device with a particularly simple construction is provided.

In one advantageous refinement of the invention, the second energy store comprises a counter-spring for providing the adjustable counterforce. A brake device with a particularly simple construction is also provided by way of this.

In one advantageous refinement of the invention, an adjusting element is provided such that it interacts with the second energy store for setting the adjustable counterforce. In this way, the magnitude of the adjustable counterforce can be set by way of the adjusting element in normal operation, whereas, in the case of an emergency, the adjusting element is inactive and the maximum brake force is provided.

In one advantageous refinement of the invention, the adjusting element comprises an actuator for loading and unloading the second energy store. In this way, by way of actuation of the actuator, the second energy store, for example the counter-spring, can be loaded by way of stressing with brake energy and can be unloaded by way of relieving. The magnitude of the adjustable counterforce can thus be set. A brake device with a particularly simple construction is also provided by way of this.

In one advantageous refinement of the invention, the actuator of the adjusting element is configured as a hollow shaft drive. By way of this, a brake device with particularly compact dimensions is provided, which brake device occupies a particularly small amount of installation space.

In one advantageous refinement of the invention, a first triggering path and a second triggering path are provided for triggering the brake device. The brake device provides the variable brake force in the case of an active first triggering path, and the brake device provides the maximum brake force in the case of an active second triggering path. Here, a triggering path is understood to mean a signal running path of a control signal for controlling the brake device, which control signal passes through a plurality of components of the brake device. Here, the first and the second triggering path run parallel to one another at least in sections and therefore form two alternatives for triggering the brake device. By way of the provision of the second triggering path which is safety-relevant in contrast to the first triggering path, merely the energy which is required for operating the second triggering path has to be provided for the case where the energy supply is interrupted. Here, the energy requirement for the second triggering path of considerably simpler construction is lower, which permits a simpler construction. Therefore, the energy requirement which is reduced by way of the second triggering path leads to a simpler construction of the brake device which provides an adjustable brake force.

In one advantageous refinement of the invention, a triggering element is provided for activating the second energy store in the case of an active, second triggering path, the second energy store being decoupled from the first energy store after activation of the second energy store. After activation of the second energy store, the adjustable counterforce is therefore decoupled from the energy store. A change from the first triggering path to the second triggering path can be brought about by way of the triggering element, in which change the second energy store is activated, with the result that an adjustable counterforce no longer acts, which reduces the maximum brake force which is provided by the brake energy store. Therefore, the brake device has a particularly simple construction.

In one advantageous refinement of the invention, a clutch is provided as triggering element. The clutch can provide a force-transmitting connection via a positively locking connection or frictionally locking connection. A change from the first triggering path to the second triggering path and, at the same time, an activation of the displacement-force converter are possible in a particularly simple way by way of the clutch. Thus, the clutch fulfills a dual function. This simplifies the construction of the brake device. Furthermore, the clutch can be configured in such a way that energy is required only for opening the clutch. This once again reduces the energy requirement.

In one advantageous refinement of the invention, the first triggering path is assigned a regulator for setting the variable brake force. Therefore, a brake force can be provided which corresponds to the loading state and/or wear state of the brake device of the car. It can thus be ensured, for example, that the deceleration does not exceed a defined value, for example from 0.8 to 1 g, even in the case of a car which is loaded only slightly. Therefore, the risk of injury to elevator passengers during a brake operation of the car is minimized. Moreover, the wear state can be taken into consideration during operation. Furthermore, in the case of a brake device which acts on both sides of the car, the mechanical loading of the car by way of a torque can be reduced.

In one advantageous refinement of the invention, the first triggering path is configured so as to operate according to the open circuit principle. Here, the open circuit principle is understood to mean that the brake device is open or released if a brake control signal which is not equal to zero is present, such as an electric current or an electric voltage. Therefore, the first triggering path which provides the brake force of desired magnitude can be of particularly energy-efficient configuration. The brake device can therefore provide a variable brake force which can be set by way of controlling or regulating, in energy-efficient operation.

In one advantageous refinement of the invention, the second triggering path is configured so as to operate according to the closed circuit principle. Here, the closed circuit principle is understood to mean that the brake device is open or released if a brake control signal which is equal to zero is present, such as an electric current or an electric voltage. Therefore, the second triggering path which provides the maximum brake force can meet safety-relevant requirements in energy-efficient operation.

In one advantageous refinement of the invention, the brake device comprises a self-locking gear mechanism for setting the variable brake force, which gear mechanism is assigned to the first triggering path. The self-locking gear mechanism can be, for example, a spindle mechanism. In this way, additional energy is necessary only to set the variable brake force, but not to maintain a set brake force value. Therefore, the energy requirement of the brake device is once again reduced.

Further advantages and refinements of the invention result from the description and the appended drawing.

It goes without saying that the features which are mentioned in the above text and are still to be explained in the following text can be used not only in the respectively specified combination, but rather also in other combinations or on their own, without departing from the scope of the present invention.

FIG. 1 diagrammatically shows one preferred embodiment of an elevator according to the invention which is denoted overall by the designation 2.

The elevator 2 comprises a car 4 for transporting persons and/or loads, which car 4 can be moved in or counter to the direction of gravity g in an elevator shaft along two guide rails 6*a*, 6*b* which run parallel to one another. In a deviation from the present embodiment, however, the car 4 can, for example, also be capable of being moved along a single guide rail.

A drive 50 which is configured as a traction sheave drive in the present embodiment is provided for moving the car 4. Here, the car 4 can comprise a cabin and a safety frame (both not shown). According to the present embodiment, the drive 50 comprises a suspension means 8, such as suspension ropes, which is fastened to the top side of the car 4. The suspension means 8 runs on a traction sheave 12 which can be driven in a motorized manner by means of a motor (not shown), in order to move the car 4. At the other end which lies opposite the car 4, a counterweight 10 is fastened according to the present embodiment, which counterweight 10 reduces the expenditure of force for moving the car 4 by way of weight equilibrium. In a deviation from the present embodiment, however, another drive can also be used, such as, for example, a linear drive.

In order to brake the car 4 to a standstill, for example when excess speeds and/or uncontrolled driving movements of the car 4 occur, a brake device 14 is provided which is configured in the present embodiment as a service brake and/or safety catch device and is arranged on both sides of the car 4, with the result that the brake device 14 acts on the two guide rails 6*a* and 6*b*.

Figure 2:
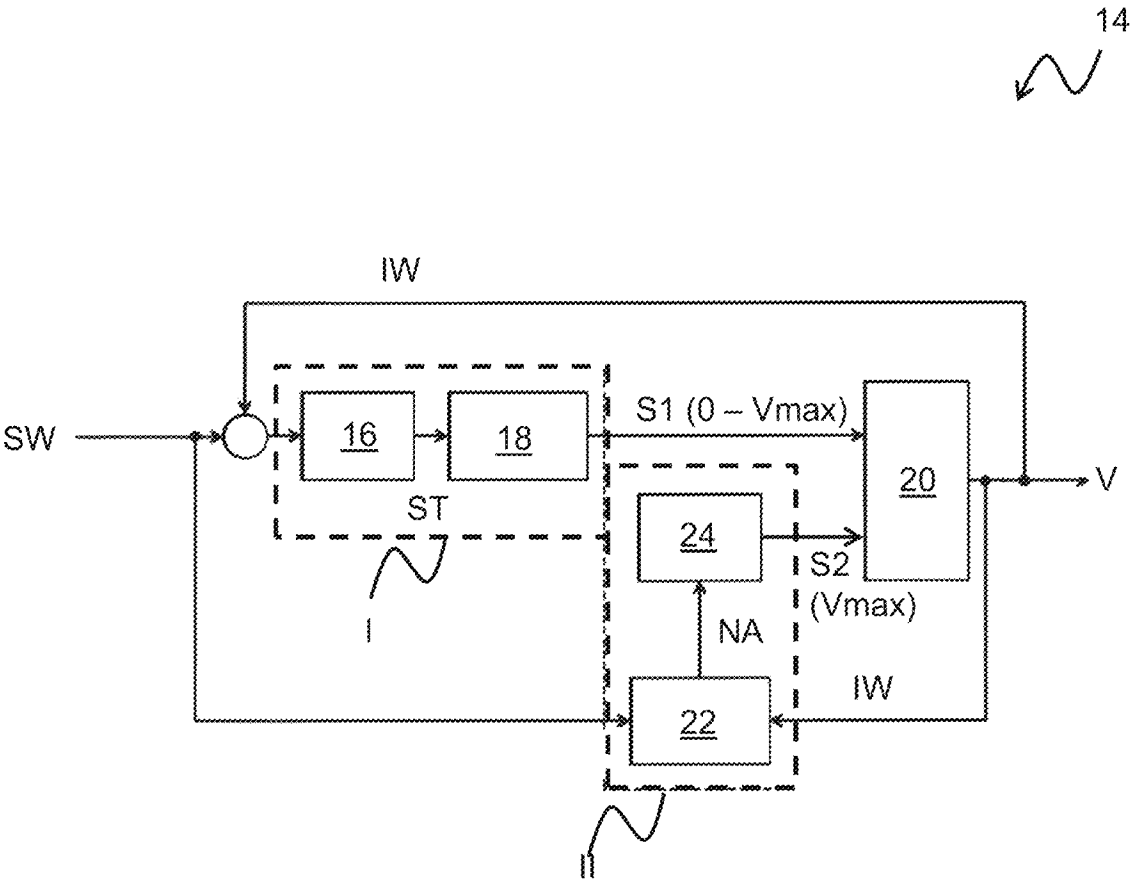
FIG. 2 is a diagrammatic view of an example brake device.

FIG. 2 shows the brake device 14 in detail.

According to the present embodiment, the brake device 14 comprises a regulator 16, an adjusting element 18, a brake unit 20, a comparison unit 22 and an emergency triggering means 24.

According to the present embodiment, the brake device 14 is released electrically. As an alternative, the brake device can also be released hydraulically or pneumatically.

In normal operation, a setpoint value SW for the deceleration is fed to the brake device 14 in a manner which is dependent on the degree of loading of the car 4. The setpoint value SW is compared with a measured actual value IW of the deceleration, and the difference, that is to say the regulating deviation, is fed to the regulator 16 which determines an actuating variable ST in a manner which is based on said difference between the setpoint value SW and the actual value IW.

The actuating variable ST is fed to the adjusting element 18 which transmits a first control signal 51 to the brake unit 20 for providing a variable brake force V between a minimum brake force and a maximum brake force Vmax. The value of the minimum brake force can also be zero. Therefore, a first triggering path I of the brake device 14 is active in normal operation, the first triggering path I comprising the regulator 16 and the adjusting element 18 according to the present embodiment. Therefore, the regulating deviation is fed as an input to the first triggering path I, and the first control signal 51 actuates the brake unit 20 as an output.

In order to ensure safe operation of the elevator 2 in the case of a failure of the energy supply of the elevator 2 and an associated failure, for example, of the regulator 16 or the adjusting element 18, a second triggering path II is provided.

In order to activate the second triggering path II, the difference of the setpoint value SW and the actual value IW is compared with a predefined limit value by the comparison unit 22. To this end, the comparison unit 22 can comprise a comparator. If the difference exceeds the predefined limit value, an impermissible excess speed of the car 4 is indicated.

Upon this, an emergency triggering signal NA is generated by the comparison unit 22 and is transmitted to the emergency triggering means 24. The emergency triggering means generates a second control signal S2 which is transmitted to the brake unit 20 for providing the maximum brake force Vmax. Therefore, a second triggering path II is active in the case of a fault, the second triggering path II comprising the comparison unit 22 and the emergency triggering means 24 according to the present embodiment. Therefore, the difference of the setpoint value SW and the actual value IW is fed as an input to the second triggering path II, and the second control signal S2 actuates the brake unit 20 as an output.

In order to ensure reliable operation of the brake device 14, for example in the case of an interruption of the energy supply of the elevator 2, the brake device 14 comprises a buffer battery (not shown) which supplies components of the brake device 14, such as, for example, the comparison unit 22, with electric energy.

Therefore, the brake unit 20 can be actuated in normal operation via the first triggering path I and, in the case of a fault, via the second triggering path II, in order to provide a brake force. Here, the variable brake force V, a regulated brake force according to the present embodiment, is provided via the first triggering path I, whereas the maximum brake force Vmax is provided via the second triggering path II.

The first triggering path I is therefore not safety-relevant, whereas the second triggering path II is safety-relevant. Therefore, only the components of the second triggering path II are to be designed and checked in a safety-relevant manner.

In a deviation from the present embodiment, a control of the variable brake force V can also be provided instead of a regulation of the brake force.

Figure 3:
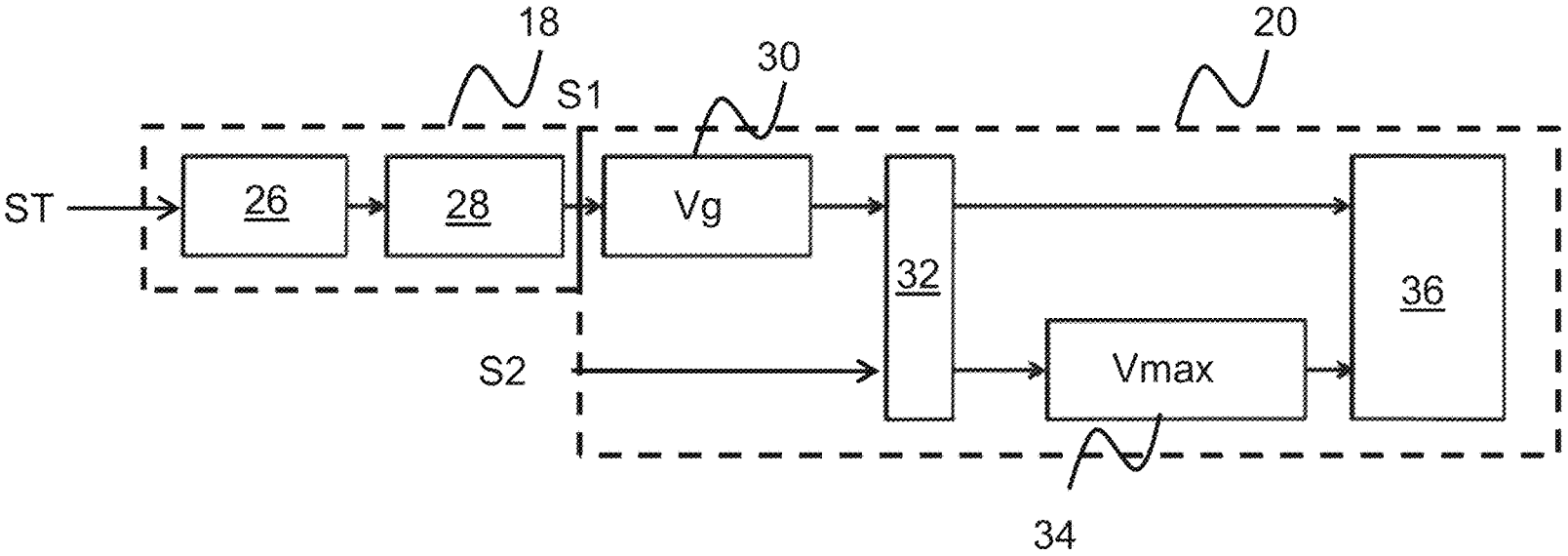
FIG. 3 is a diagrammatic view showing further detail of the example brake device of FIG. 2.

FIG. 3 shows the construction of the adjusting element 18 and the brake unit 20 of the brake device 14 in detail.

According to the present embodiment, the adjusting element 18 comprises an actuator 26 and a gear mechanism 28 which is connected on the input side to the actuator 26. The actuator 26 can be an electric motor. As an alternative, the actuator can also be a hydraulic or pneumatic cylinder. The gear mechanism 28 can be a self-locking gear mechanism, such as, for example, a spindle mechanism.

A displacement-force converter 30 of the brake unit 20 is connected on the output side to the gear mechanism 28. Furthermore, according to the present embodiment, the brake unit 20 comprises a clutch 32, a first energy store 34 and a brake 36.

The displacement-force converter 30 can comprise an elastic element, such as, for example, a spring, which converts a displacement change into a force change. Here, the displacement change is provided by the adjusting element 18 by way of the actuator 26 and the gear mechanism 28. Here, a self-locking configuration of the gear mechanism 28 brings it about that relieving of the elastic element does not take place in the case of deactivation of the adjusting element 18, for example on account of an interruption of the energy supply of the elevator 2, but rather the elastic element maintains its shape.

In the case of a change from the first triggering path I to the second triggering path II, the clutch 32 decouples the adjusting element 18 from the displacement-force converter 30 and releases brake energy, as will be described later.

The first energy store 34 provides the maximum brake force Vmax, as will likewise be described later.

Depending on whether it is triggered via the first triggering path I or the second triggering path II, the brake 36 provides the variable brake force V or the maximum brake force Vmax.

Figure 4:
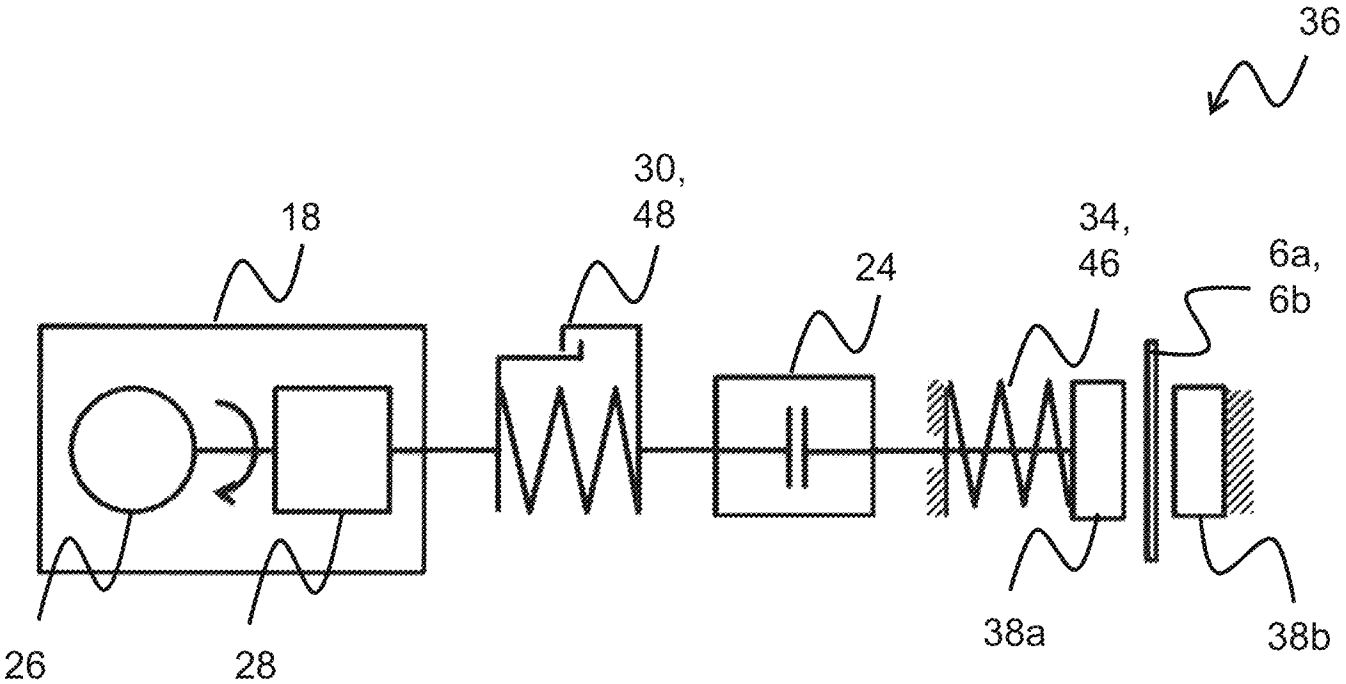
FIG. 4 is a diagrammatic view of showing still further details of the example brake device of FIG. 3.

FIG. 4 shows further details of the displacement-force converter 30, the first energy store 34 and the brake 36 of the brake device 2.

According to the present embodiment, the displacement-force converter 30 is assigned a second energy store 48. According to the present embodiment, the second energy store is a counter-spring. The first energy store 34 comprises a compression spring 46. Furthermore, FIG. 4 shows that the brake 36 comprises two brake linings 38*a*, 38*b* which act on both sides on the guide rail 6*a* or 6*b*.

Figure 5:
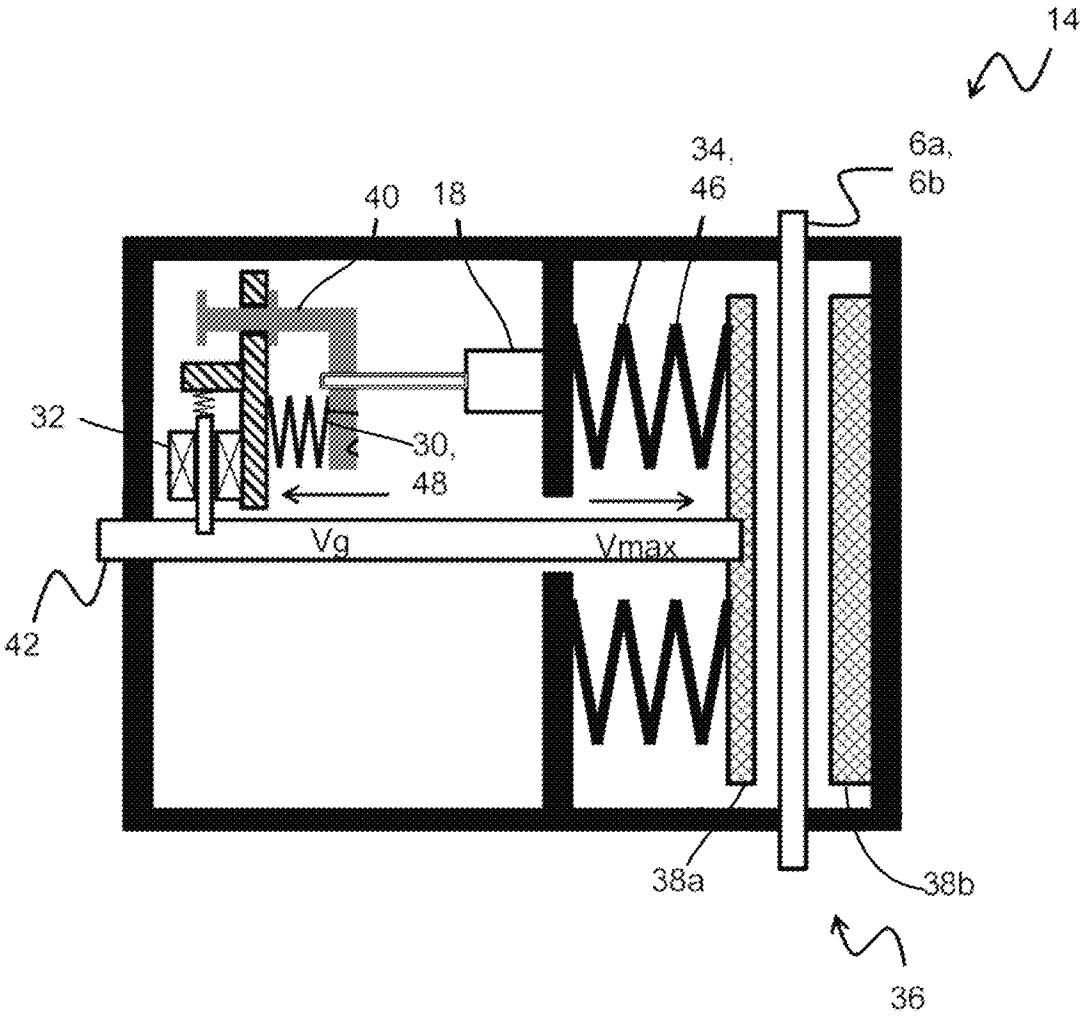
FIG. 5 is a diagrammatic sectional view through another example brake device in an open state.

FIG. 5 diagrammatically shows a section through a first embodiment of the brake device 14 with the brake 36 in the open state.

It can be seen that the adjusting element 18 with the actuator 26 (shown in FIG. 4) and the gear mechanism 28 is arranged between the displacement-force converter 30 and the first energy store 34.

Therefore, the first energy store 34 is connected with its first end to the brake lining 38*a* in a force-transmitting manner, whereas the second end of the brake energy store 34 is connected to the brake housing 44 in a force-transmitting manner. Therefore, the brake device 14 is mounted on the car 4 in a floating manner. A second end of the adjusting element 18 is connected to a first end of the displacement-force converter 30 in a force-transmitting manner.

Furthermore, it can be seen using FIG. 5 that a second end of the displacement-force converter 30 is connected to a first end of the clutch 32 in a force-transmitting manner. The second end of the clutch 32 is in engagement with a triggering shaft 42 of the brake device 14, which triggering shaft 42 is in turn connected with its front end to the brake lining 38*a*.

Furthermore, a stop device 40 is arranged parallel to the displacement-force converter 30, which stop device 40 limits the movement of the clutch 32 in relation to the adjusting element 18, caused by way of stressing or relieving of the displacement-force converter 30.

The first energy store 34 provides the maximum brake force Vmax, whereas the second energy store 48 provides the adjustable counterforce Vg which reduces the maximum brake force Vmax. The adjustable counterforce Vg can assume values from the minimum brake force up to the maximum brake force Vmax, it also being possible for the minimum brake force to be zero. Therefore, the maximum brake force Vmax and the adjustable counterforce Vg are superimposed in a subtractive manner.

Figure 6:
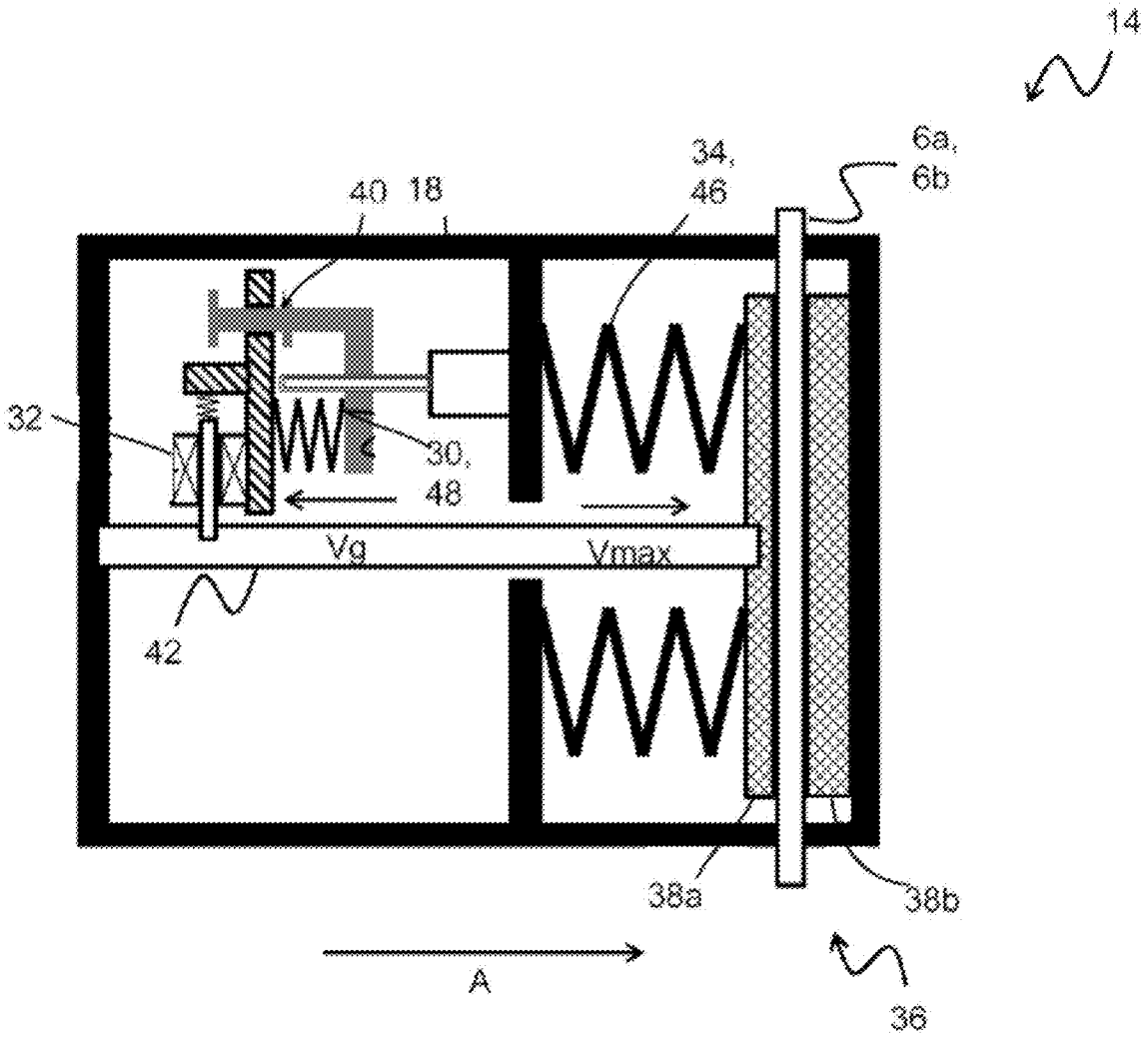
FIG. 6 is a schematic view of the brake device of FIG. 5 in a closed state.

FIG. 6 shows that, in order to set the variable brake force V, for example according to the comparison of the setpoint value SW and the actual value IW, the adjusting element 18 can be moved along the direction of extent of the triggering shaft 42 by way of the actuator 26 and the gear mechanism 28, after the brake linings 38*a*, 38*b* have been brought into contact with the guide rail 6*a*, 6*b*. Here, the first triggering path I is active.

On account of the active clutch 32 which is in engagement with the triggering shaft 42, the adjusting element 18 is moved in the arrow direction A, which brings about relieving of the counter-spring by way of unloading of the second energy store 48. The consequence of this displacement change is that the counter-spring of the second energy store 48 provides a reduced adjustable counterforce Vg, with the result that the variable brake force V which acts is increased. If, in contrast, the adjusting element 18 is moved counter to the arrow direction A, this brings about stressing of the counter-spring by way of loading of the second energy store 48. The consequence of this displacement change is that the counter-spring of the second energy store 48 provides an increased adjustable counterforce Vg, with the result that the variable brake force V which acts is decreased.

Figure 7:
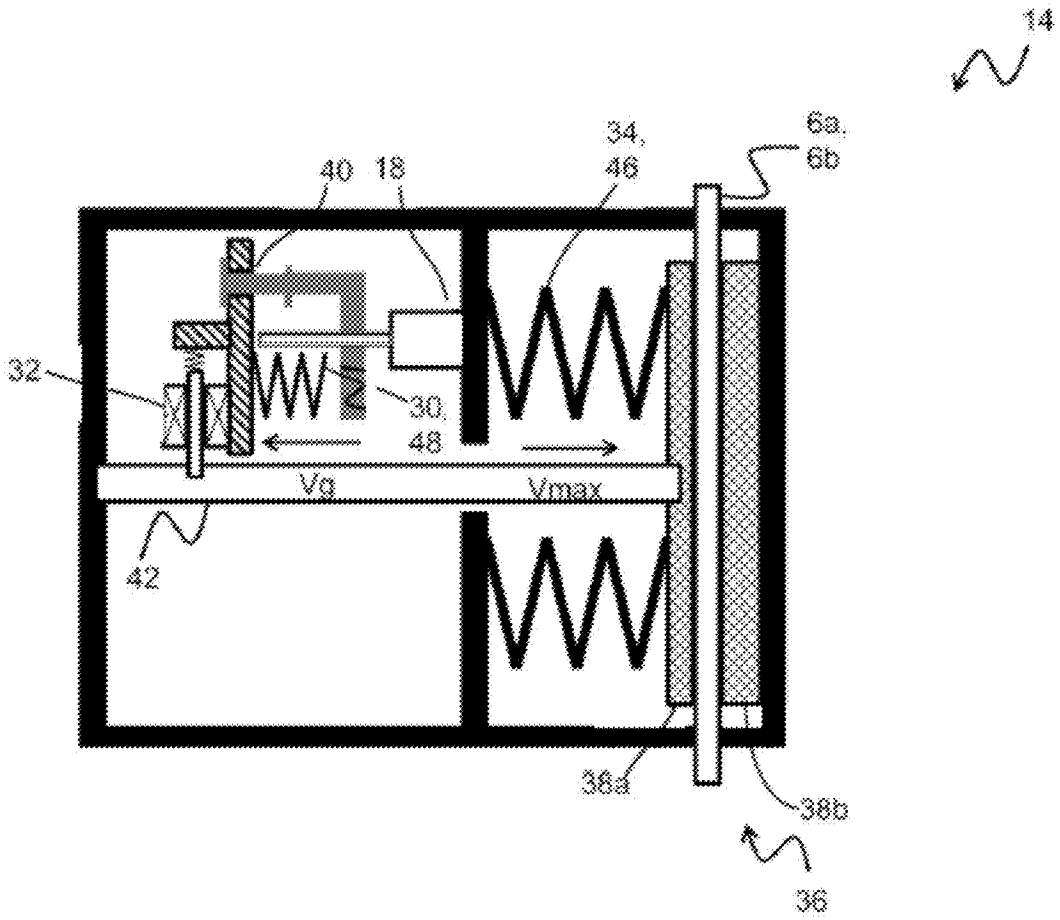
FIG. 7 is a schematic view of the brake device of FIG. 5 in the closed state such that the brake device provides a maximum brake force via a first triggering path.

FIG. 7 shows that the movement of the adjusting element 18 in the arrow direction A is limited by the stop device 40. In this situation, the counter-spring of the second energy store 48 does not provide an adjustable counterforce Vg, with the result that the brake device 14 provides the maximum brake force Vmax.

Figure 8:
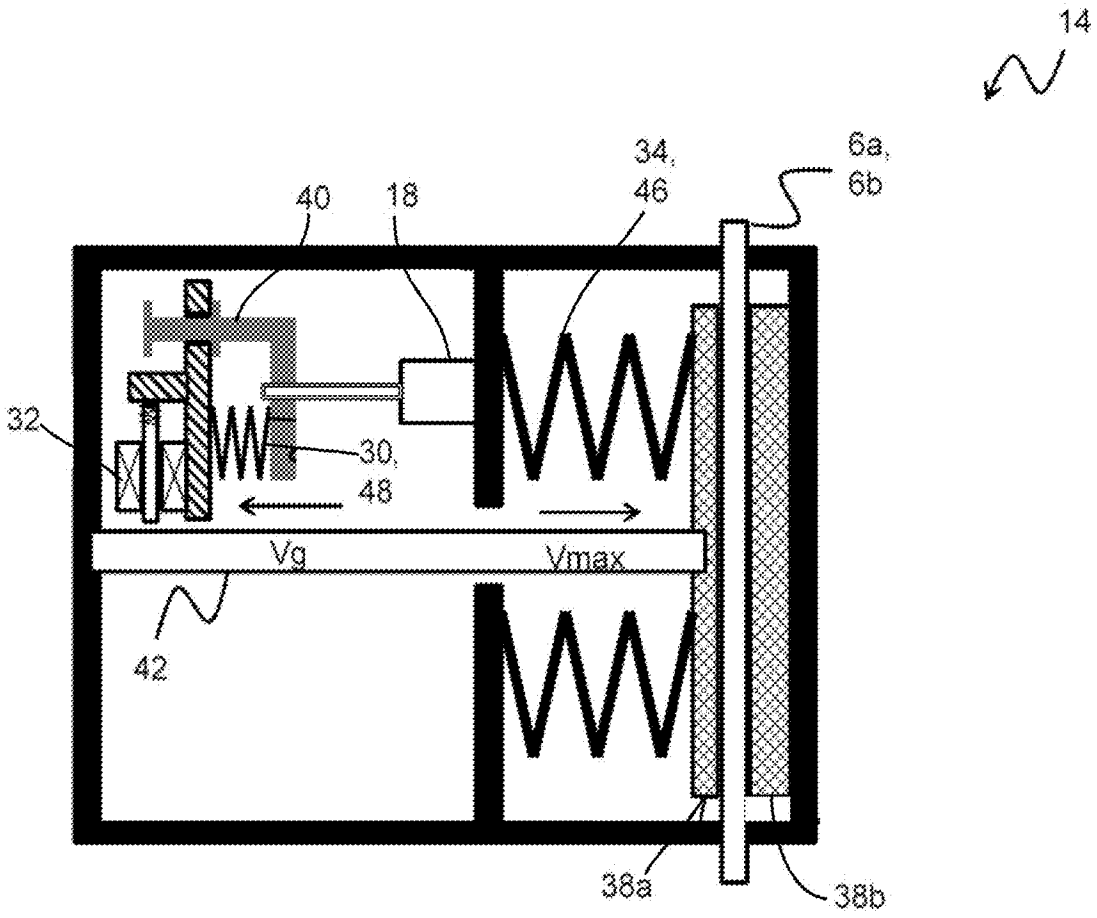
FIG. 8 is a schematic view of the shows the brake of FIG. 5 in the closed state such that the brake device provides a maximum brake force via a second triggering path.

FIG. 8 shows the brake device 14 in the case of a fault after failure of the energy supply and an associated failure, for example, of the regulator 16 or the adjusting element 18 and the occurrence of an excess speed. Here, the second triggering path II is active.

The clutch 32 is hereupon deactivated by the triggering element 24, with the result that the clutch 32 is no longer in engagement with the triggering shaft 42. Therefore, the counter-spring of the second energy store 48 is decoupled from the adjusting element 18 by way of releasing. Therefore, no adjustable counterforce Vg which reduces the maximum brake force Vmax of the brake energy store 34 is provided, with the result that the brake device 14 provides the maximum brake force Vmax.

In order to transfer the brake device 14 into normal operation again after the fault has been eliminated, the adjusting element 18 is activated. As a result, the counter-spring of the second energy store 48 is relieved again. Moreover, the stop device 40 is also driven until the clutch 32 latches on the triggering shaft 42 again at the position which is shown in FIG. 5. Furthermore, the adjusting element 18 is activated, with the result that the adjusting element 18 operates counter to the compression spring 46 of the brake energy store 34, in order thus to release the brake linings 38*a*, 38*b* from the guide rail 6*a* or 6*b*. The brake device 14 can then be operated in normal operation again.

Figure 9:
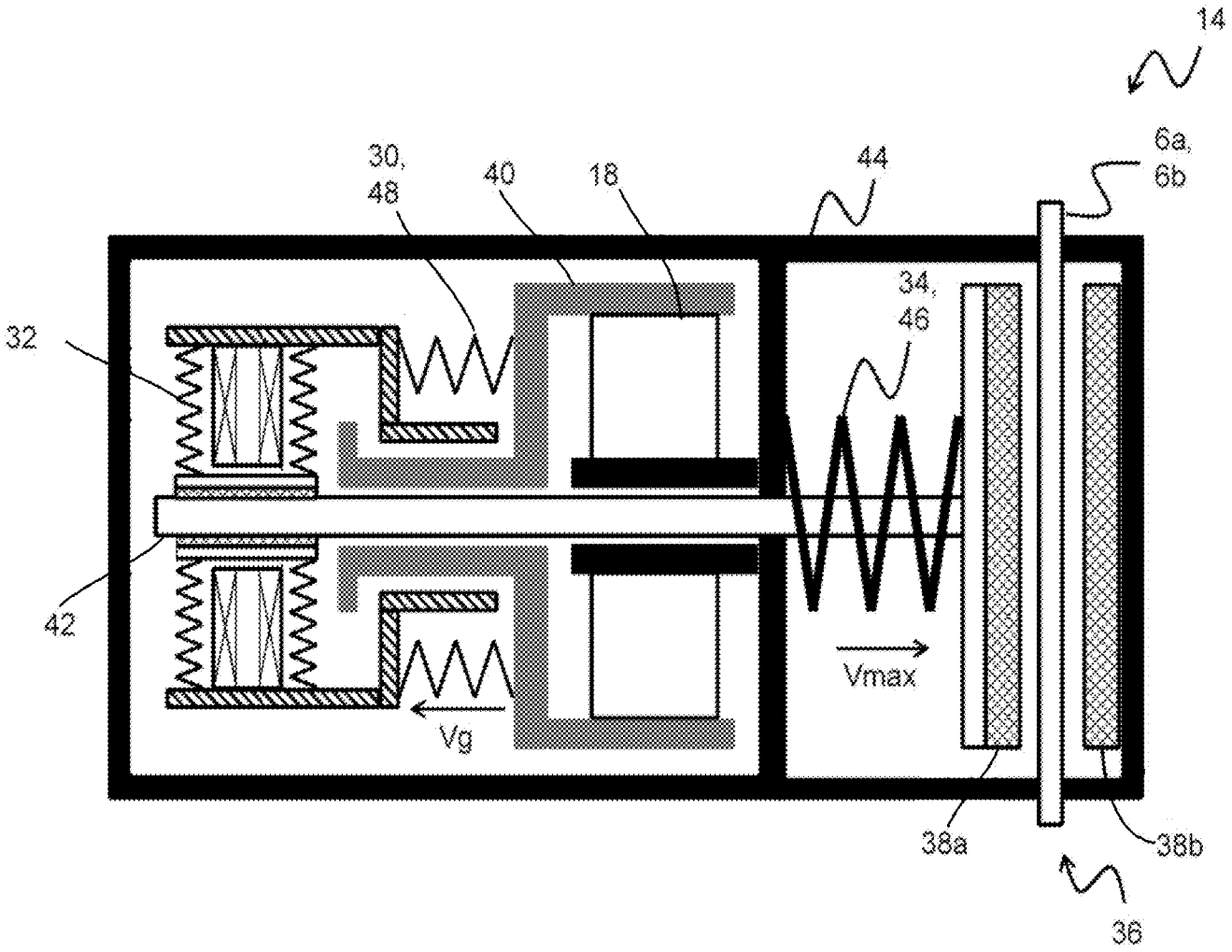
FIG. 9 is a schematic sectional view of yet another example brake device in an open state.

FIG. 9 diagrammatically shows a section through the brake device 14 in the open state according to a further embodiment.

The brake device 14 and its components, namely the adjusting element 18, the first energy store 34 in the form of a compression spring 46, the displacement-force converter 30, the second energy store 48 in the form of a counter-spring, the clutch 32 and the stop device 40 and the brake linings 38*a*, 38*b*, are received in a housing 44. Here, the actuator 26 is configured as a hollow shaft drive and is in engagement with the triggering shaft 42. According to this embodiment, the clutch 32 can bring about a transmission of force by way of a frictionally locking connection, which permits particularly rapid activation of the brake 36.

What is claimed is:

1. An elevator comprising a brake device configured to provide a variable brake force from a minimum brake force up to a maximum brake force, the brake device comprising:

a first energy store configured to provide the maximum brake force;

a second energy store configured to provide an adjustable counterforce that is directed in an opposed manner with respect to the maximum brake force, wherein the variable brake force amounts to a difference between the maximum brake force and the adjustable counter-force;

a first triggering path;

a second triggering path for triggering the brake device, wherein the brake device provides the variable brake force when the first triggering path is active, wherein the brake device provides the maximum brake force when the second triggering path is active; and a triggering element configured to activate the first energy store when the second triggering path is active, wherein the first energy store is decoupled from the second energy store after activation of the first energy store.

2. The elevator of claim 1 wherein the first energy store comprises a compression spring for providing the maximum brake force.

3. The elevator of claim 1 wherein the second energy store comprises a counter-spring for providing the adjustable counterforce.

4. The elevator of claim 1 further comprising an adjusting element that interacts with the second energy store to set the adjustable counterforce.

5. The elevator of claim 4 wherein the adjusting element comprises an actuator for loading and unloading the second energy store.

6. The elevator of claim 5 wherein the actuator is configured as a hollow shaft drive.

7. The elevator of claim 1 wherein the triggering element comprises a clutch.

8. The elevator of claim 1 wherein the first triggering path is associated with a regulator that sets the variable brake force.

9. The elevator of claim 1 wherein the first triggering path is configured to operate according to an open circuit principle.

10. The elevator of claim 1 wherein the second triggering path is configured to operate according to a closed circuit principle.

11. The elevator of claim 1 wherein the brake device comprises a self-locking gear mechanism for setting the variable brake force, wherein the self-locking gear mechanism is associated with the first triggering path.

12. A brake device for an elevator, the brake device being configured to provide a variable brake force from a minimum brake force up to a maximum brake force, the brake device comprising:

a first energy store configured to provide the maximum brake force;

a second energy store configured to provide an adjustable counterforce that is directed in an opposed manner with respect to the maximum brake force, wherein the variable brake force amounts to a difference between the maximum brake force and the adjustable counter-force;

a first triggering path;

a second triggering path for triggering the brake device, wherein the brake device provides the variable brake force when the first triggering path is active, wherein the brake device provides the maximum brake force when the second triggering path is active; and a triggering element configured to activate the first energy store when the second triggering path is active, wherein the first energy store is decoupled from the second energy store after activation of the first energy store.

13. The brake device of claim 12 wherein the first energy store comprises a compression spring for providing the maximum brake force.

14. The brake device of claim 12 wherein the second energy store comprises a counter-spring for providing the adjustable counterforce.

15. The brake device of claim 12 further comprising an adjusting element that interacts with the second energy store to set the adjustable counterforce.

16. The brake device of claim 15 wherein the adjusting element comprises an actuator for loading and unloading the second energy store.

17. The brake device of claim 16 wherein the actuator is configured as a hollow shaft drive.

18. The brake device of claim 12 wherein the triggering element comprises a clutch.

19. The brake device of claim 12 wherein the first triggering path is associated with a regulator that sets the variable brake force.

20. An elevator comprising a brake device configured to provide a variable brake force from a minimum brake force up to a maximum brake force, the brake device comprising:

a first energy store configured to provide the maximum brake force;

a second energy store configured to provide an adjustable counterforce that is directed in an opposed manner with respect to the maximum brake force, wherein the variable brake force amounts to a difference between the maximum brake force and the adjustable counter-force;

a first triggering path;

a second triggering path for triggering the brake device, wherein the brake device provides the variable brake force when the first triggering path is active, wherein the brake device provides the maximum brake force when the second triggering path is active; and a triggering element configured to activate the first energy store when the second triggering path is active, wherein the first energy store is decoupled from the second energy store after activation of the first energy store;

wherein the triggering element comprises a clutch.

21. A brake device for an elevator, the brake device being configured to provide a variable brake force from a minimum brake force up to a maximum brake force, the brake device comprising:

a first energy store configured to provide the maximum brake force;

a second energy store configured to provide an adjustable counterforce that is directed in an opposed manner with respect to the maximum brake force, wherein the variable brake force amounts to a difference between the maximum brake force and the adjustable counter-force;

a first triggering path;

a second triggering path for triggering the brake device, wherein the brake device provides the variable brake force when the first triggering path is active, wherein the brake device provides the maximum brake force when the second triggering path is active; and a triggering element configured to activate the first energy store when the second triggering path is active, wherein the first energy store is decoupled from the second energy store after activation of the first energy store;

wherein the triggering element comprises a clutch.

* * * * *